US006698154B2

(12) United States Patent
Vance

(10) Patent No.: US 6,698,154 B2
(45) Date of Patent: Mar. 2, 2004

(54) WINDOW TRIM FOR RECREATIONAL VEHICLES

(75) Inventor: Dennis R. Vance, Edwardsburg, MI (US)

(73) Assignee: ASV Plastics, Inc., Elkhart, IN (US)

( * ) Notice: Subject to any disclaimer, the term of this patent is extended or adjusted under 35 U.S.C. 154(b) by 0 days.

(21) Appl. No.: 10/017,443

(22) Filed: Dec. 14, 2001

(65) Prior Publication Data

US 2003/0110732 A1 Jun. 19, 2003

(51) Int. Cl.[7] ..... E04C 2/38

(52) U.S. Cl. ..... 52/716.6; 52/718.05; 52/208; 296/216.06

(58) Field of Search ..... 52/204.62, 204.69, 52/204.7, 204.71, 204.53, 204.54, 204.591, 716.5, 716.6, 716.7, 717.01, 717.06, 718.01, 718.04, 718.05, 718.06, 208; 296/216.06, 216.07, 216.08, 216.09

(56) References Cited

U.S. PATENT DOCUMENTS

| | | | | | |
|---|---|---|---|---|---|
| 2,058,248 | A | * | 10/1936 | Menges | 52/716.5 |
| 3,087,537 | A | | 4/1963 | LaVan | 160/91 |
| 3,808,742 | A | | 5/1974 | Ehret et al. | 49/413 |
| 4,042,004 | A | * | 8/1977 | Kwan | 160/91 |
| 4,114,233 | A | | 9/1978 | Hamilton | 16/95 R |
| 4,165,083 | A | * | 8/1979 | Dochnahl | 277/184 |
| 4,233,781 | A | | 11/1980 | Roe | 49/504 |
| 4,656,807 | A | * | 4/1987 | Anhegger et al. | 52/718.1 |
| 4,750,781 | A | * | 6/1988 | Betteridge | 296/214 |
| 5,243,800 | A | * | 9/1993 | Olbrich | 52/287 |

* cited by examiner

*Primary Examiner*—Carl D. Friedman
*Assistant Examiner*—Naoko N Slack
(74) *Attorney, Agent, or Firm*—Baker & Daniels

(57) ABSTRACT

The present invention involves a window trim system with a bracket and trim ring, and a method of installing the same. The window trim system includes a clamping bracket which is press fit and screwed into preformed channels in the window frame. The clamping bracket has a receiving portion, such as a depression or catch, for interfitting with an engagement portion of the trim ring, such as a protrusion or catch. A trim ring is then snapped into place over the clamping bracket, thus hiding the screw head from sight. Advantageously, the window trim system is capable of securing the window frame to the vehicle wall with a minimal number of brackets and screws.

35 Claims, 7 Drawing Sheets

WINDOW TRIM FOR RECREATIONAL VEHICLES

BACKGROUND OF THE INVENTION

1. Field of the Invention

The invention relates to window assemblies for recreational vehicles, and more particularly, to structures for securing such window assemblies in walls of recreational vehicles.

2. Description of the Related Art

The use of recreational vehicles has increased dramatically over the last several years. Due to the large amount of time people often spend in recreational vehicles, it is important that the interior of these vehicles be pleasing in appearance. Toward this end, numerous improvements have been made to the living space provided in recreational vehicles, including, e.g., the addition of room extensions and specialty windows.

Along these lines, recreational vehicles typically include several windows, each of which is initially assembled separately and installed as part of an assembly. A typical window assembly comprises a frame having a plurality of channels for mounting one or more window panels, and a circumferential flange for overlapping the interior surface of the frame to secure the window assembly to the wall.

Conventionally, a plurality of screws are drilled around the periphery of the interior circumferential flange of the window frame. Although this method secures the frame to the wall, it has numerous disadvantages. For instance, securing the window frame to the wall of the recreational vehicle in the conventional manner typically requires numerous screws. Each screw must then be individually and manually drilled into the window frame and through the wall. Finally, for cosmetic reasons, the heads of these screws are typically painted to match the color of the window trim. Although the screw heads are individually painted, they are still clearly visible from the interior of the vehicle.

A further disadvantage is that, due to the large number of screws required to secure the window frame to the wall, a large margin of error exists. For example, the screws may be drilled to the frame at the wrong location, or they may be drilled at an angle, rather than straight as desired. Errors such as these are likely to result in an unsatisfactory installation, which may lead to problems with ineffective sealing and eventual leaking.

This conventional installation process is unsatisfactory because it results in a window which is displeasing in appearance and which is susceptible to seal failure.

What is needed in the art is a window mounting which is more efficient and less time consuming to install, and which is aesthetically pleasing to the end user.

SUMMARY OF THE INVENTION

The present invention is a window trim system with brackets and a trim ring for effectively and efficiently securing a window frame to the wall of a recreational vehicle. The window trim system of the present invention positions the trim ring such that it contributes aesthetically to the appearance of the interior of the vehicle.

The present invention involves an apparatus for installing a window frame in a fixed position in an aperture in a vehicle wall. The window frame is shaped to conform to the shape of the aperture in the wall surface to which it is being installed. The frame includes means for mounting one or more window panels, and has a circumferential flange for overlapping the interior surface of the frame, such that the frame partially or completely surrounds the aperture. The frame is an extruded unitary structure typically manufactured from a soft metal, such as aluminum alloy.

The window assembly is secured to the wall of the recreational vehicle through the use of the clamping brackets and trim ring of the present invention. Advantageously, the present invention allows the window frame to be secured to the wall of the recreational vehicle with a minimal number of clamping brackets.

The clamping bracket of the present invention comprises an elongated flange having first and second ends. The first end of the flange is press fit into a channel in a predetermined location in the window frame. Once the clamping bracket is press fit into the window frame, a screw is drilled through a groove disposed at the second end of the flange, through the flange of the bracket, and finally through the preformed channel in the window frame. In this manner, the bracket and screws serve to secure the window assembly to the wall of the recreational vehicle.

Once the screw and clamping bracket have secured the window frame to the wall, the trim ring of the present invention is introduced. The trim ring is adapted for attachment with the clamping brackets, and is snapped and locked onto the brackets to hide the screw heads from sight. The use of the trim ring obviates the need to manually paint the screw heads, and the trim ring may be provided in a color which is complementary with the window frame.

The clamping bracket and trim ring of the present invention may be used on the exterior of the recreational vehicle as well. For example, the clamping bracket and the trim ring may be used on the exterior of the recreational vehicle in order to secure the window assembly to the exterior wall of the recreational vehicle. Additionally, the clamping bracket and trim ring of the present invention may be used to secure the exterior wall panels to the internal support structure, i.e., support beams or joists, of the recreational vehicle.

An object of the present invention is to provide a window trim system which is capable of efficiently and effectively installing a window assembly into a wall in a recreational vehicle.

Another object of the present invention is to provide a window trim system which improves the aesthetic quality of the interior of a recreational vehicle.

BRIEF DESCRIPTION OF THE DRAWINGS

The aforementioned and other features and objects of this invention, and the manner of attaining them, will become apparent and the invention itself will be better understood by reference to the following description of several embodiments of the invention taken in conjunction with the accompanying drawings, wherein.

Figure 1:
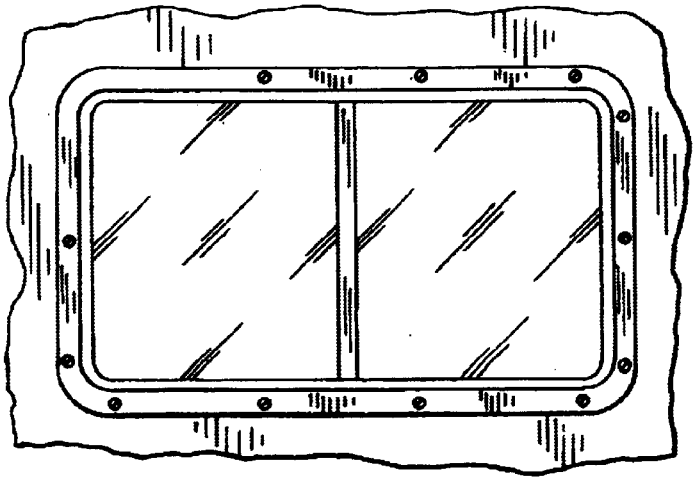
FIG 1 PRIOR ART
FIG. 1 is a perspective view of a window having a window trim of the prior art.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates an embodiment of the invention, in one form, and such exemplifications are not to be construed as limiting the scope of the invention in any manner.

DETAILED DESCRIPTION OF THE PRESENT INVENTION

The embodiments disclosed below are not intended to be exhaustive or to limit the invention to the precise form disclosed in the detailed description. Rather, the embodiments are chosen and described so that others skilled in the art might utilize their teachings.

FIG. 1 is a perspective view of the interior of a window secured through the use of a prior art window trim. Screws 56 can be plainly seen from the interior of the vehicle.

Figure 2:
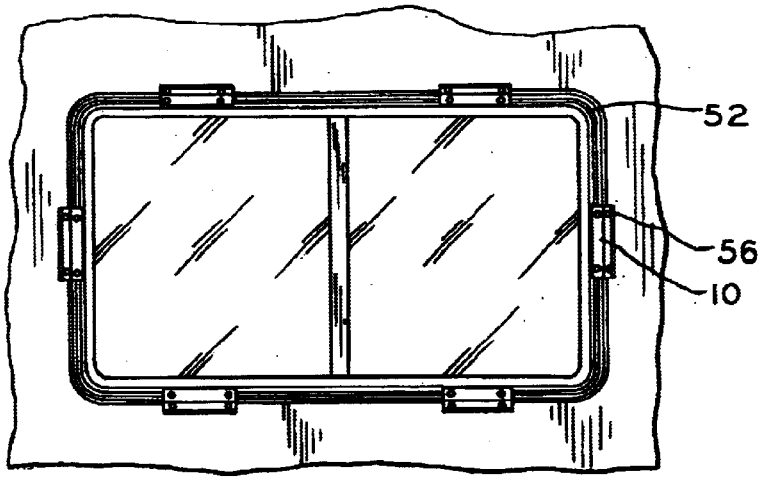
FIG. 2 is a perspective view of a window having a window trim fitted with the clamping brackets of the present invention.

FIG. 2 depicts a window secured with brackets 10 of the present invention. FIG. 2 could be either an interior view or an exterior view of the window, depending on whether the brackets and trim ring sections of the present invention are installed on the interior or the exterior of the window. Although the particular embodiment depicted shows the use of six clamping brackets, it is contemplated that as few as one up to several brackets may be utilized depending upon the size, shape, and weight of the window being installed and the amount of sealing that is necessary for the installation.

Figure 3:
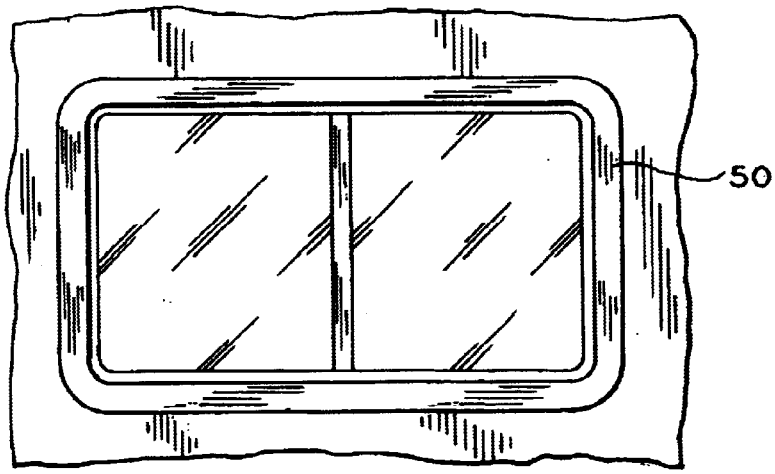
FIG. 3 is a perspective view of a window fitted with the window trim of the present invention.

FIG. 3 is an exterior view of a window which has been fully installed with exterior trim 50 held over a window frame 51 installed with brackets 10 and one or more trim rings 30 of the present invention.

Figure 4:
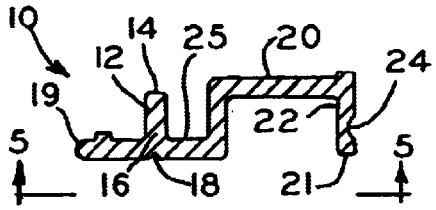
FIG. 4 is a cross-sectional view of a clamping bracket of the present invention.
Figure 5:
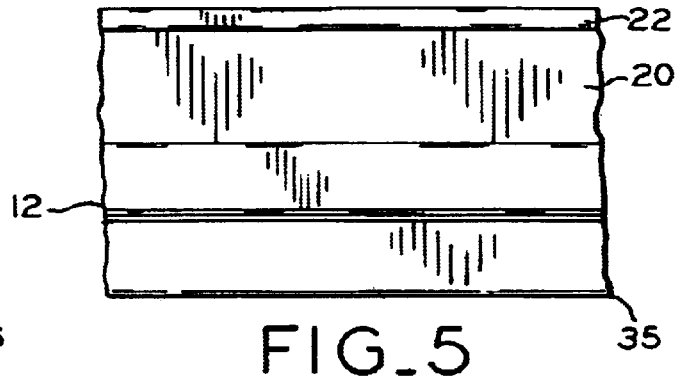
FIG. 5 is the bracket of FIG. 4 taken along line 5—5.

With reference to FIG. 4, clamping bracket 10 includes flange 12, which with branch 20, defines channel 25. Flange 12 has first end 14 and second end 16. Second end 16 of flange 12 includes groove 18. Clamping bracket 10 further comprises first end 19, second end 21, branch 20, and arm 22. Arm 22 extends at a substantially right angle from branch 20, and arm 22 includes depression 24. Branch 20 lies flush with the interior circumferential flange of the window frame. FIG. 5 is an elevational view of the bottom of bracket 10, taken along lines 5—5 of FIG. 4.

Figure 11:
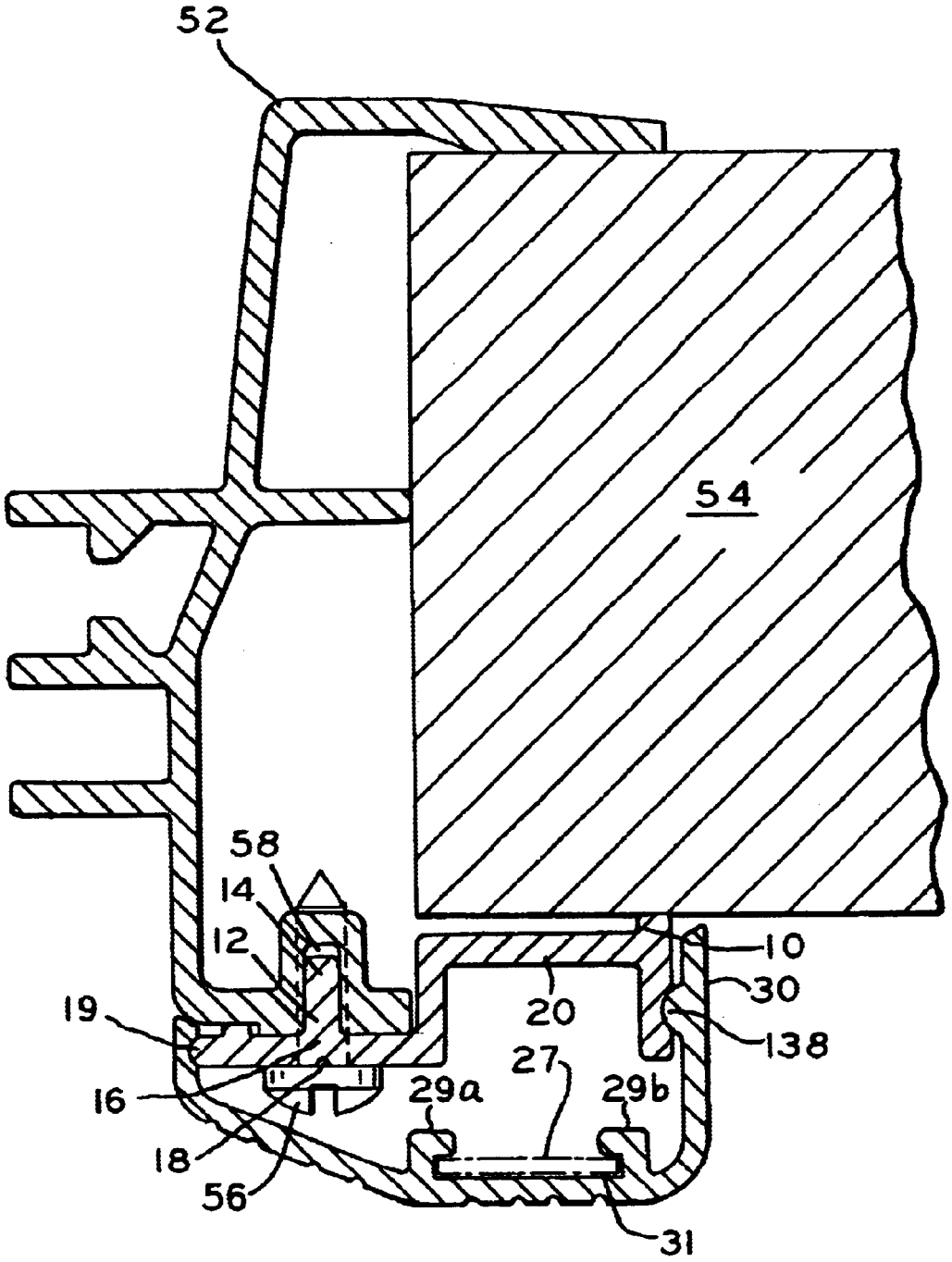
FIG. 11 is similar to FIG. 7, but depicts the orientation of the clamping bracket of FIG. 4 and trim ring of FIG. 6 with the window frame.

Flange 12 of bracket 10 mounts bracket 10 with window frame 52 as it is adapted to be press fit into preformed channel 58 in window frame 52 (as seen in FIG. 11). Once first end 14 of flange 12 is press fit into the preformed channel in window frame 52, screw 56 (as seen in FIG. 11) is drilled through groove 18 disposed at second end 16 of flange 12. Screw 56 travels through flange 12, either by drilling through the material of flange 12 or by extending through a preformed opening in flange 12, and into window frame 52, thereby mounting and securing bracket 10 to window frame 52.

Figure 6:
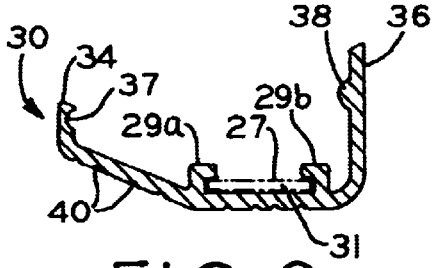
FIG. 6 is a cross-sectional view of a trim ring adapted for use with the clamping bracket of FIG. 4.

FIG. 6 depicts the uniform cross-sectional aspect of trim ring 30. Trim ring 30 is adapted to snap onto or be press fit over bracket 10. Trim ring section 30 comprises first end 34 and second end 36. First end 34 includes depression 37, which may be manually snapped onto first end 19 of bracket 10. Depression 37 receives first end 19 of bracket 10, such that first end 34 is engaged with first end 19 of bracket 10. Second end 36 of trim ring 30 includes protrusion 38. Protrusion 38 is adapted to be received by depression 24 disposed in second end 21 of bracket 10. In this manner, trim ring 30 may be manually snapped onto, and, by virtue depression 24 receiving protrusion 38, and by first end 19 of bracket 10 receiving depression 37, be retained by bracket 10. Alternatively, trim ring 30 may be manually press fit over bracket 10 to make the same connections as described above.

Slot 27, defined by projections **29*a*, 29*b*, is formed on the interior surface of trim ring 30. Slot 27 is adapted to accommodate the insertion of connector 31, for example a piece of soft metal such as aluminum or a hard polymer, which acts to connect the ends of a single trim ring section 30 or connect ends of individual sections of trim rings 30. Advantageously, slot 27 and projections 29***a*, 29*b* allow the window trim to be completed without an overlap. This gives the illusion that the window trim is a single circumferential piece, and is more aesthetically pleasing than the conventional method which leaves an undesirable overlap where the window trim is pulled together. Additionally, notches 40, or any variety of aesthetically pleasing features, may be added to the exterior surface of trim ring 30.

Bracket 10 and trim ring 30 are preferably manufactured by an extrusion process from a soft metal, e.g., aluminum and aluminum alloys, or a hard polymer. However, it is contemplated that other materials could be utilized so long as they are malleable and strong enough to effectively install the window in the recreational vehicle.

As discussed herein above, bracket 10 and trim ring section 30 are adapted to be mounted in either the exterior or the interior of the recreational vehicle. When mounted on the exterior of the vehicle, brackets 10 and trim ring 30 may function to secure the window assembly to the outer exterior walls of the recreational vehicle.

Figure 7:
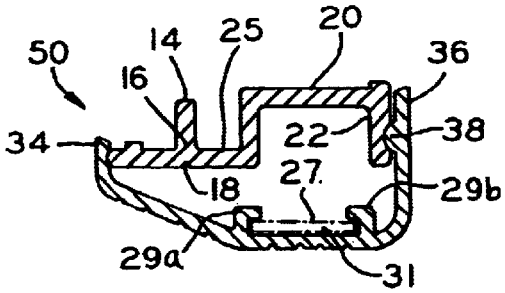
FIG. 7 is a cross-sectional view of the clamping bracket of FIG. 4 attached to the trim ring of FIG. 6.

FIG. 7 depicts window trim 50, which is a combination of bracket 10 and trim ring 30. Trim ring 30 is snapped or press fit onto bracket 10, such that depression 37 of trim ring 30 receives first end 19 of bracket 10 and depression 24 of bracket 10 receives protrusion 38 of trim ring section 30. When trim ring 30 is snapped or press fit onto bracket 10, trim ring 30 and bracket 10 are affixed together. The fixture of bracket 10 and trim ring 30 may be further secured by an adhesive or by the strength of the crimping of trim ring 30 on bracket 10. If desired, the affixation may be decreased by changing or deleting such affixative or by decreasing the extent of crimping.

Figure 8:
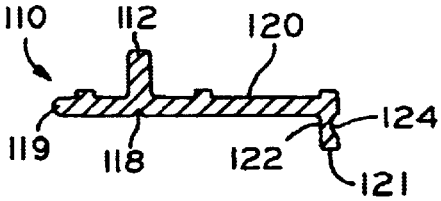
FIG. 8 is a cross-sectional view of an alternative embodiment of the clamping bracket of the present invention.
Figure 10:
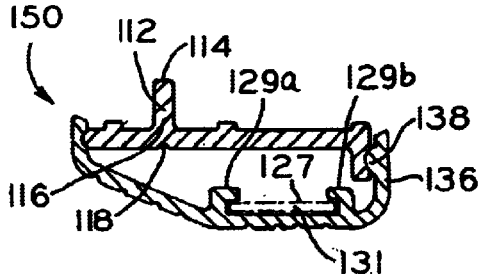
FIG. 10 is a cross-sectional view of the clamping bracket of FIG. 8 attached to the trim ring of FIG. 9.
Figure 9:
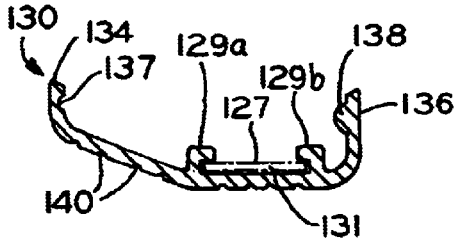
FIG. 9 is a cross-sectional view of an alternative embodiment of the trim ring which is adapted for use with the clamping bracket of FIG. 8.

FIGS. 8–10 are similar to FIGS. 4–7, but depict an alternative embodiment. In this embodiment, the body of bracket 110 includes branch 120 which extends straight across to arm 122. Arm 122 extends at a substantially right angle from branch 120, and arm 122 includes second depression 124.

FIG. 11 depicts the orientation of window trim 50 with window frame 52 disposed in recreational vehicle wall 54. Window frame 52 is inserted onto vehicle wall 54 from the exterior of the vehicle. In order to install bracket 10 in window frame 52, first end 14 of flange 12 is press fit into preformed channel 58 in window frame 52. By press fitting first end 14 of flange 12 into window frame 52, bracket 10 is temporarily secured in window frame 52. Screw 56 is then drilled into groove 18 in second end 16 of flange 12. By drilling screw 56 through flange 12 and into frame 52, bracket 10 is secured in, and attached to, window frame 52. The length of bracket 10 may be varied to accommodate any number of screws which may be drilled through flange 12 of bracket 10. Branch 20 lies flush with window frame 52 to fix window frame 52 on vehicle wall 54.

Figure 12:
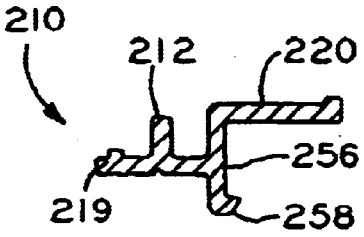
FIG. 12 is a cross-sectional view of an alternative embodiment of the clamping bracket of the present invention.
Figure 13:
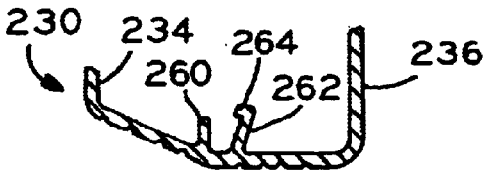
FIG. 13 is a cross-sectional view of an alternative embodiment of the trim ring of the present invention.
Figure 14:
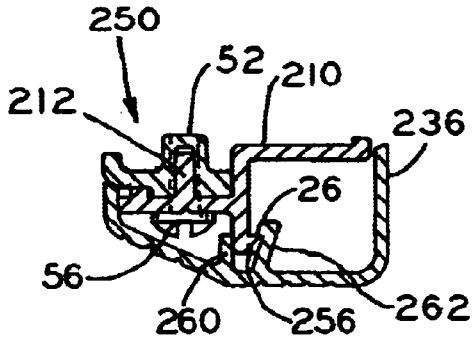
FIG. 14 is a cross-sectional view of the clamping bracket of FIG. 12 attached to the trim ring of FIG. 13.

FIGS. 12–14 depict an alternative embodiment in which bracket 210 comprises first branch 220 and second branch 256. Second branch 256 includes catch 258. With reference to FIG. 13, trim ring section 230 comprises first and second arms 260, 262. Second arm 262, in this embodiment, is slightly longer than first arm 260, and is resilient. Second arm 262 further comprises catch 264. Second branch 256 is adapted for insertion between arms 260, 262, such that when second branch 256 of bracket 210 is inserted between arms 260, 262, second arm 262 flexes to accommodate second branch 256. Catch 258 of second branch 256 and catch 264 of second arm 262 engage one another, causing bracket 210 and trim ring 230 to be secured to one another (FIG. 14).

Figure 15:
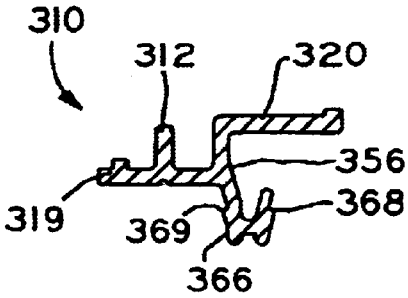
FIG. 15 is a cross-sectional view of an alternative embodiment of the clamping bracket of the present invention.
Figure 17:
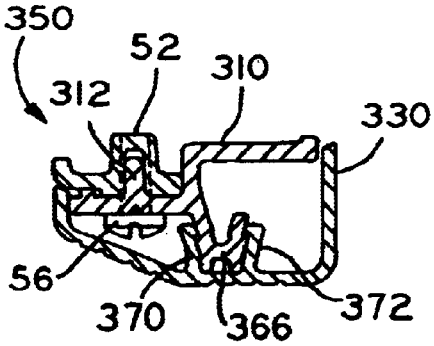
FIG. 17 is a cross-sectional view of the clamping bracket of FIG. 15 attached to the trim ring of FIG. 16.
Figure 16:
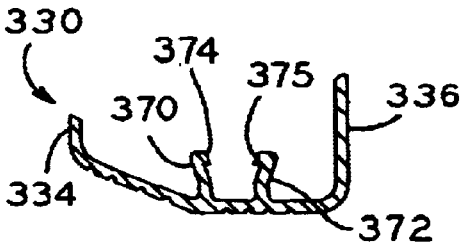
FIG. 16 is a cross-sectional view of an alternative embodiment of the trim ring of the present invention.

FIGS. 15–17 depict another alternative arrangement. Bracket 310 comprises first branch 320 and second branch 356. Second branch 356 comprises H-shaped structure 366. H-shaped structure 366 further comprises a pair of notches 368, 369. FIG. 15 depicts trim ring 330 which includes first and second arms 370, 372. First and second arms 370, 372 are resilient and each include catches 374, 375. As shown in FIG. 17, H-shaped structure 366 is received by arms 370, 372 of trim ring 330, and notches 368, 369 of H-shaped structure 366 are caught by catches 374, 375 of first and second arms 370, 372. By press fitting arms 370, 372 over H-shaped structure 366, bracket 310 is secured to trim ring 330.

Figure 18:
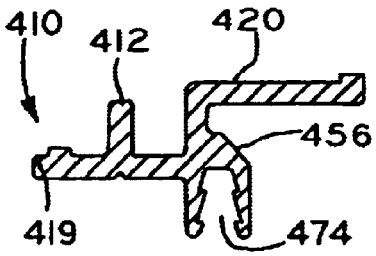
FIG. 18 is a cross-sectional view of an alternative embodiment of the clamping bracket of the present invention.
Figure 19:
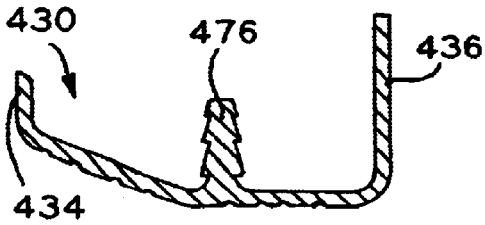
FIG. 19 is a cross-sectional view of an alternative embodiment of the trim ring of the present invention.
Figure 20:
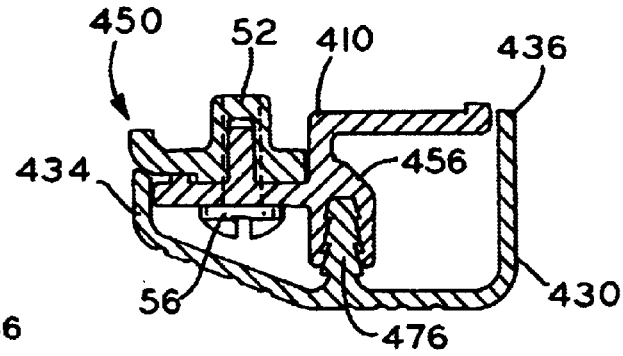
FIG. 20 is a cross-sectional view of the clamping bracket of FIG. 18 attached to the trim ring of FIG. 19.

FIGS. 18–20 depict an alternative arrangement in which bracket 410 comprises first branch 420 and second branch 456. Second branch 456 includes aperture 474. Aperture 474 may be virtually any size or shape, and as depicted in FIGS. 18–20, resembles a Christmas tree. Trim ring 430 comprises structure 476 which corresponds in size and shape with aperture 474, such that structure 476 may be manually press fit into aperture 474 of bracket 410.

Figure 21:
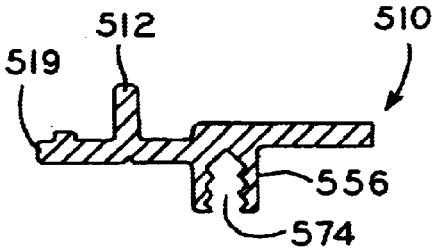
FIG. 21 is a cross-sectional view of an alternative embodiment of the clamping bracket of the present invention.
Figure 22:
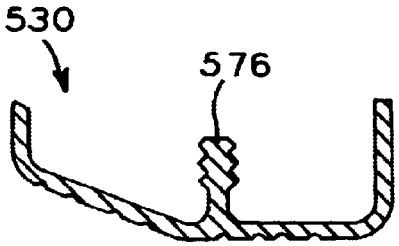
FIG. 22 is a cross-sectional view of an alternative embodiment of the trim ring of the present invention.
Figure 23:
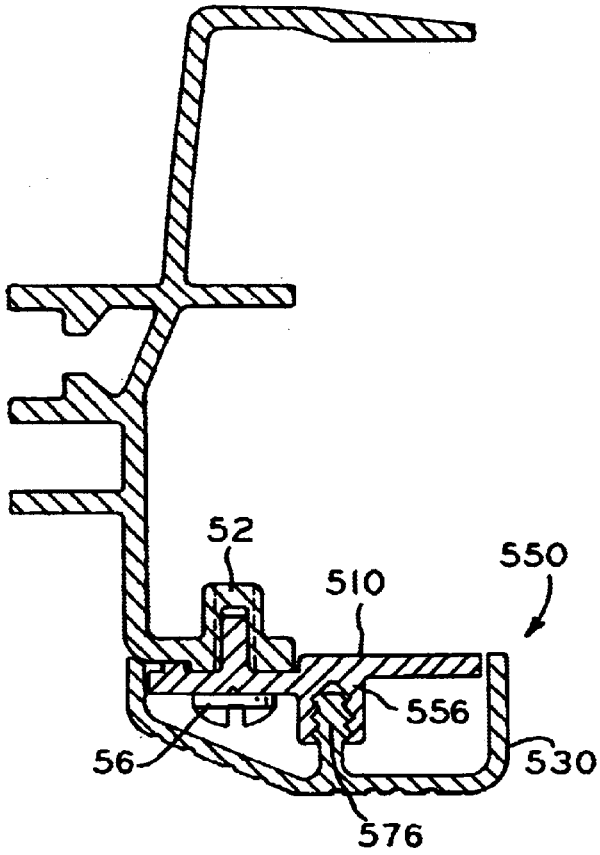
FIG. 23 is a cross-sectional view of the clamping bracket of FIG. 21 attached to the trim ring of FIG. 22, the combination mounted on a window frame.
Figure 24:
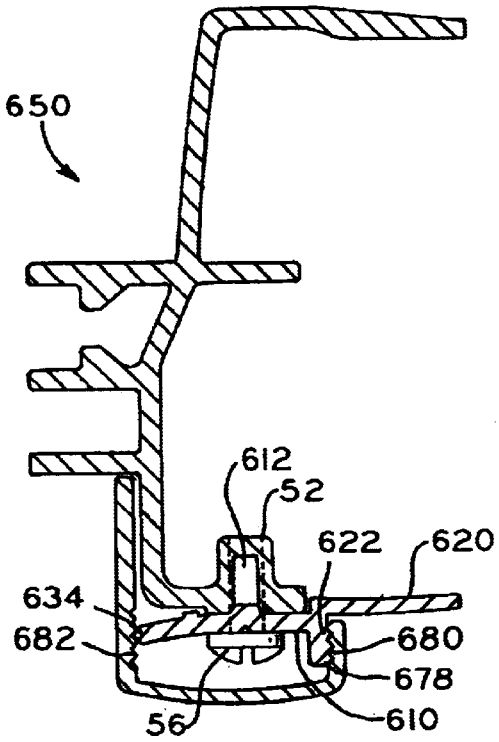
FIG. 24 is a cross-sectional view of an alternative embodiment of the clamping bracket and trim ring combination mounted on a window frame.
Figure 25:
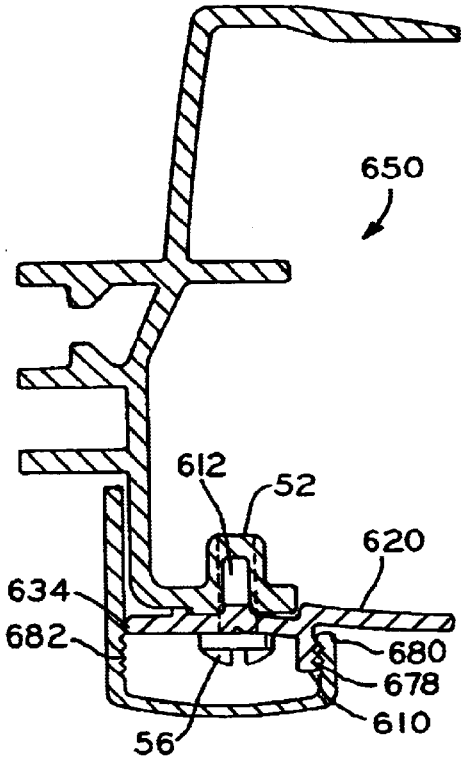
FIG. 25 is a cross-sectional view of an alternative embodiment of the clamping bracket and trim ring combination mounted on a window frame.
Figure 26:
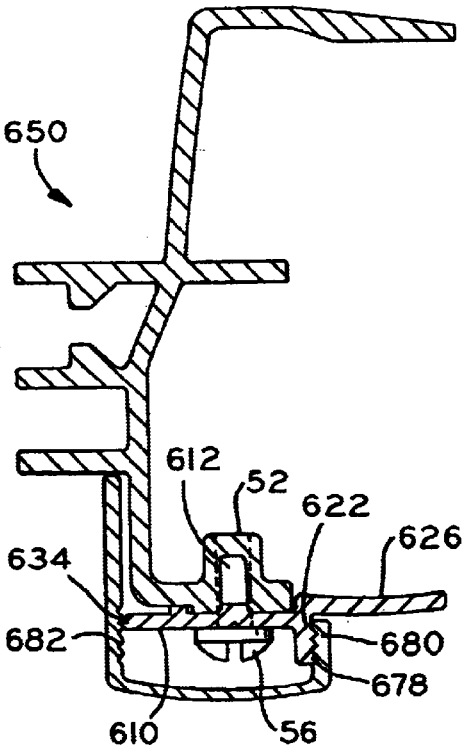
FIG. 26 is a cross-sectional view of the clamping bracket of FIG. 24 attached to the trim ring combination of FIG. 25.
Figure 27:
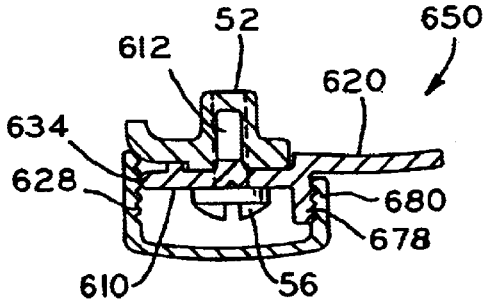
FIG. 27 is a cross-sectional view of an alternative embodiment of the clamping bracket and the trim ring combination of the present invention, and depicts the trim ring coming into contact with the clamping bracket.

FIGS. 21–23 are similar to FIGS. 17–19, but depict aperture 574 of bracket and structure 576 of trim ring 530 as a serrated size and shape. FIG. 23 illustrates the orientation of trim ring system 550 with window frame 52.

FIGS. 24–27 depict an alternative embodiment in which bracket 610 comprises branch 620 having arm 622. Arm 622 comprises a plurality of teeth 678 which correspond with, and engage teeth 680 of trim ring 630. Additionally, end 634 of bracket 610 is adapted to engage teeth 682 of trim ring 630. FIGS. 24–27 also depict the insertion of bracket 610 into trim ring 630.

Figure 28:
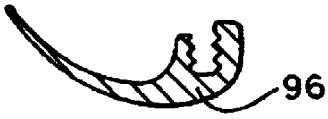
FIGS. 28–30 are cross-sectional views of further alternative embodiments of the clamping bracket and the trim ring of the present invention.
Figure 30:
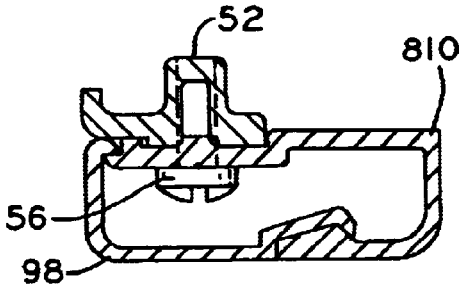
Figure 29:
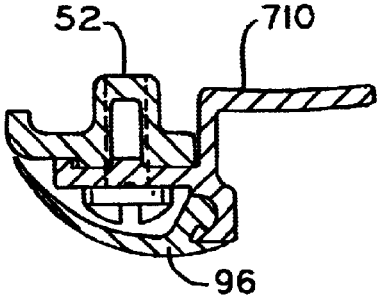

FIGS. 28–30 depict covers 96 and 98 which engage brackets 710 and 810, so that the trim ring apparent in the vehicle interior is provided by both the bracket and the cover.

Figure 31:
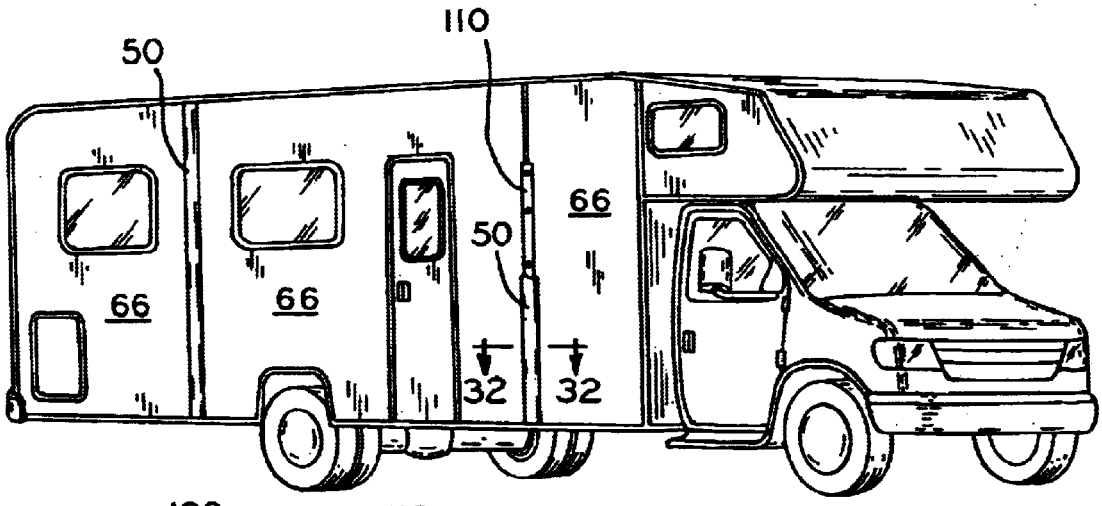
FIG. 31 is a perspective view of a recreational vehicle having its exterior wall panels secured through the use of the clamping bracket and trim ring of the present invention.
Figure 32:
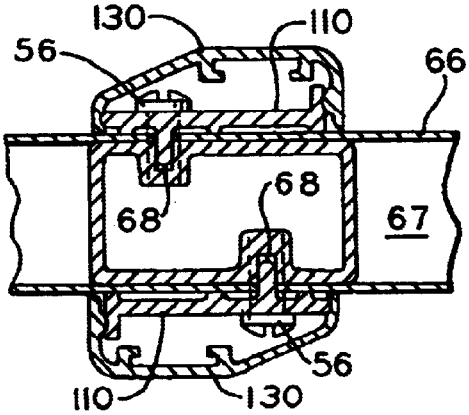
FIG. 32 is taken along line 32—32 of FIG. 31.

FIG. 31 is an exterior view of a recreational vehicle having its exterior wall panels 66 secured to the support beams or joists 67 through the use of bracket 110 and trim ring 130. When bracket 110 and trim ring 130 are used to secure exterior wall panels 66 to the internal support structure, i.e., support beams or joists 67, of the recreational vehicle, flange 112 of bracket 110 is press fit into preformed channel 68 in support beam 67. Screw 56 is then drilled through groove 118 of flange 112, and bracket 110 is secured to support beam 67. Trim ring 130 is installed in the same manner discussed above with respect to the installation of a window assembly. FIG. 32 is taken along line 32—32 of FIG. 31, and is a cross-sectional view of bracket 110 and trim ring 130 securing exterior wall panel 66 to support beam 67.

The various alternative constructions of brackets and trim rings may be manufactured in a uniform cross-sectional aspect by an extrusion process, although other manufacturing processes, such as sheet metal stamping, may be employed to construct these structures. While the exemplary embodiments are described as using a soft metal, structures which may mount window frames and engage trim rings may also be made from polymer or similar materials. Both the brackets and trim rings may be manufactured in a variety of lengths, then cut for particular dimensions or loading conditions. For example, a bracket may be relatively narrow and only accommodate one screw for a light weight load, or may be relatively wide to accommodate several screws for a heavy load or wind resistance.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A trim assembly for use on a panel adapted for installation in a wall of a recreational vehicle, said trim assembly comprising:

a bracket, said bracket comprising a mounting portion and a receiving portion, said mounting portion adapted to attach to the support structure of said recreational vehicle and said receiving portion including first and second body portions; and a trim ring, said trim ring defining an exterior surface adapted to cover said bracket, said trim ring including an engagement portion adapted to connect with said receiving portion of said bracket and comprising a long member, a short member, and an angled member, all of which define an open side, wherein said long member comprises one attached end and one free end, said long member free end located along a first boundary defining said open side, said short member comprises one attached end and one free end, said short member free end located along a second boundary defining said open side, said angled member comprises first and second legs, said long member being oriented generally parallel to said short member with said long member attached end connected to said short member attached end by said angled member, said engagement portion adapted to connect with said receiving portion of said bracket by said long and short members each having one of a protuberance and a depression, said long and short member being resiliently displaceable so as to create an interference fit between said long member free end and said short member free end of said engagement portion and said first and second body portions each having one of a corresponding protuberance and depression engaging a corresponding depression or protuberance.

2. The trim assembly of claim 1, wherein said panel comprises a window.

3. The trim assembly of claim 1, wherein said panel comprises an exterior panel.

4. The trim assembly of claim 1, wherein said trim ring has a uniform aspect in cross-section.

5. The trim assembly of claim 1, further comprising a plurality of said brackets.

6. The trim assembly of claim 1, wherein said trim ring composes a plurality of trim ring sections.

7. The trim assembly of claim 1, wherein said first body portion comprises first and second legs, said first leg having a free end and an attached end, the attached end connected to the base of a first alignment formation, and said second leg having two attached ends, one end attached to a point along a line segment defined by the length of said first alignment formation, the location of said point defined by the thickness of the panel, and the remaining end attached to one end of said second body portion such that said first and second body portions each have one attached end and one free end and said second leg and said second body portion are oriented generally perpendicular relative to each other so as to form an "L" shape.

8. The trim assembly of claim 7, wherein said first alignment formation facilitates the connection of said first and second legs and projects generally perpendicular to said first and second legs.

9. The trim assembly of claim 1, wherein said first leg comprises a first radial protuberance projecting from the terminus of said free end of said first leg, a second alignment formation adjacent to said free end of said first leg and projecting in a relatively perpendicular orientation from said first leg and oriented in the opposite direction as said second body portion, and said mounting portion.

10. The trim assembly of claim 9, wherein said mounting portion comprises a flange adapted to accept a fastening device, the junction of said flange and said first leg located at a point between said first and second alignment formations with said flange projecting in a relatively perpendicular orientation from said first leg and oriented in the same direction as said second alignment formation.

11. The trim assembly of claim 10, wherein said fastening device accepted by said mounting portion of said bracket is a screw.

12. The trim assembly of claim 11, wherein said mounting portion is capable of accommodating a plurality of screws.

13. The trim assembly of claim 1, wherein said second leg comprises a third alignment formation adjacent to the junction of said second leg and said second body portion, projecting in a relatively perpendicular orientation from said second leg and oriented in the same direction as said flange and said second alignment formation.

14. The trim assembly of claim 1, wherein said second body portion comprises a second radial protuberance projecting from the opposite side of said second body portion as said first body portion.

15. The trim assembly of claim 1, wherein said first leg is obtusely connected to said second leg so as to define a generally rectangular channel, said channel adapted to retain an insert.

16. The trim assembly of claim 15, wherein said insert constitutes a means for attaching ends of said trim ring.

17. The trim assembly of claim 1, wherein said long member attached end is perpendicularly connected to said first leg of said angled member by a radial segment, and said short member attached end is obtusely connected to said second leg of said angled member.

18. The trim assembly of claim 17, wherein said long member further comprises a first concavity and said short member further comprises a second concavity, said first concavity located on the interior surface of said long member in a position adjacent to said long member free end and opposed to said second concavity, said second concavity located on the interior surface of said short member adjacent to said short member free end and opposed to said first concavity.

19. A window trim assembly for use on a window adapted for installation in a wall, said window trim assembly comprising:

a bracket, said bracket comprising a mounting portion and a receiving portion, said mounting portion adapted to attach to the wall and said receiving portion including first and second body portions; and a trim ring, said trim ring defining an exterior surface adapted to cover said bracket, said trim ring including an engagement portion adapted to connect with said receiving portion of said bracket and comprising a long member, a short member, and an angled member, all of which define an open side, wherein said long member comprises one attached end and one free end, said long member free end located along a first boundary defining said open side, said short member comprises one attached end and one free end, said short member free end located along a second boundary defining said open side, said angled member comprises first and second legs, said long member being oriented generally parallel to said short member with said long member attached end connected to said short member attached end by said angled member, said engagement portion adapted to connect with said receiving portion of said bracket by said long and short members each having one of a protuberance and a depression, said long and short member being resiliently displaceable so as to create an interference fit between said long member free end and said short member free end of said engagement portion and said first and second body portions each having one of a corresponding protuberance and depression engaging a corresponding depression or protuberance.

20. The window trim assembly of claim 19, wherein said trim ring has a uniform aspect in cross-section.

21. The window trim assembly of claim 19, further comprising a plurality of said brackets.

22. The window trim assembly of claim 19, wherein said trim ring comprises a plurality of trim ring sections.

23. The window trim assembly of claim 19, wherein said first body portion comprises first and second legs, said first leg having a free end and an attached end, the attached end connected to the base of a first alignment formation, and said second leg having two attached ends, one end attached to a point along a line segment defined by the length of said first alignment formation, the location of said point defined by the thickness of the window, and the remaining end attached to one end of said second body portion such that said first and second body portions each have one attached end and one free end and said second leg and said second body portion are oriented generally perpendicular relative to each other so as to form an "L" shape.

24. The window trim assembly of claim 23, wherein said first alignment formation facilitates the connection of said first and second legs and projects generally perpendicular to said first and second legs.

25. The window trim assembly of claim 19, wherein said first leg comprises a first radial protuberance projecting from the terminus of said free end of said first leg, a second alignment formation adjacent to said free end of said first leg and projecting in a relatively perpendicular orientation from said first leg and oriented in the opposite direction as said second body portion, and said mounting portion.

26. The window trim assembly of claim 25, wherein said mounting portion comprises a flange adapted to accept a fastening device, the junction of said flange and said first leg located at a point between said first and second alignment formations with said flange projecting in a relatively perpendicular orientation from said first leg and oriented in the same direction as said second alignment formation.

27. The window trim assembly of claim 26, wherein said fastening device accepted by said mounting portion of said bracket is a screw.

28. The window trim assembly of claim 27, wherein said mounting portion is capable of accommodating a plurality of screws.

29. The window trim assembly of claim 19, wherein said second leg comprises a third alignment formation adjacent to the junction of said second leg and said second body portion, projecting in a relatively perpendicular orientation from said second leg and oriented in the same direction as said flange and said second alignment formation.

30. The window trim assembly of claim 19, wherein said second body portion comprises a second radial protuberance projecting from the opposite side of said second body portion as said first body portion.

31. The window trim assembly of claim 19, wherein said first leg is obtusely connected to said second leg so as to define a generally rectangular channel, said channel adapted to retain an insert.

32. The window trim assembly of claim 31, wherein said insert constitutes a means for attaching ends of said trim ring.

33. The window trim assembly of claim 19, wherein said long member attached end is perpendicularly connected to said first leg of said angled member by a radial segment, and said short member attached end is obtusely connected to said second leg of said angled member.

34. The window trim assembly of claim 33, wherein said long member further comprises a first concavity and said short member further comprises a second concavity, said first concavity located on the interior surface of said long member in a position adjacent to said long member free end and opposed to said second concavity, said second concavity located on the interior surface of said short member adjacent to said short member free end and opposed to said first concavity.

35. A method of securing a window frame in an opening in the wall of a recreational vehicle, the method comprising the steps of:

providing a clamping bracket with a mounting portion comprising a flange and a receiving portion including first and second body portions, said first and second body portions each including one of a protuberance and a depression;

providing a trim ring with an exterior surface and an engagement portion comprising resiliently displaceable long and short members each having one of a protuberance and a depression so as to cause an interference fit when attached to said first and second body portions;

fixing a screw through the flange of said mounting portion of the said clamping bracket to the window frame; and attaching the trim ring to the clamping bracket by interfitting the engagement portion with the receiving portion, wherein said screw is hidden from view and protected from elemental exposure and damage resulting therefrom by the exterior surface of the trim ring.

* * * * *